United States Patent [19]

Crilly et al.

[11] 3,979,580

[45] Sept. 7, 1976

[54] FUNCTION SELECTOR

[75] Inventors: Thomas W. Crilly, Silver Spring; Michael C. Gariazzo, Bowie, both of Md.

[73] Assignee: The United States of America as represented by the Secretary of the Navy, Washington, D.C.

[22] Filed: Apr. 15, 1975

[21] Appl. No.: 568,236

[52] U.S. Cl. ..... 235/150.53; 102/70.2 R; 328/37; 328/111

[51] Int. Cl.[2] ..... G06G 7/26; F42B 5/08

[58] Field of Search ..... 235/150.53, 153 AP, 235/150.3, 61.11 E; 307/221 R, 273; 328/207, 221, 222, 111, 112, 34, 37; 102/70, 70.2 R, 19.2, 82, 70.2 GA; 340/174 SR, 174 R

[56] References Cited

UNITED STATES PATENTS

| | | | |
|---|---|---|---|
| 3,366,881 | 1/1968 | Malone et al. | 328/111 |
| 3,418,586 | 12/1968 | Asher | 307/221 R |
| 3,530,284 | 9/1970 | Wood | 235/153 AP |
| 3,639,740 | 2/1972 | Escoffier et al. | 235/153 AP |
| 3,646,371 | 2/1972 | Flad | 102/70.2 R |
| 3,680,062 | 7/1972 | Cricchi | 102/70.2 GA |
| 3,701,096 | 10/1972 | Hunter et al. | 235/153 AP |
| 3,713,145 | 1/1973 | Butler et al. | 328/111 |
| 3,725,680 | 4/1973 | Silva | 328/207 |
| 3,763,780 | 10/1973 | Kasinoff | 102/19.2 |
| 3,772,534 | 11/1973 | Dellecave et al. | 307/273 |
| 3,821,600 | 6/1974 | Wesner | 307/273 |
| 3,828,258 | 8/1974 | Hills et al. | 328/111 |
| 3,921,009 | 11/1975 | Comas et al. | 328/112 |

*Primary Examiner*—Malcolm A. Morrison
*Assistant Examiner*—Errol A. Krass
*Attorney, Agent, or Firm*—R. Sciascia; R. Beers; S. Sheinbein

[57] ABSTRACT

A solid state electronic circuit designed to accept coded information to control the function of a mine mechanism.

7 Claims, 1 Drawing Figure

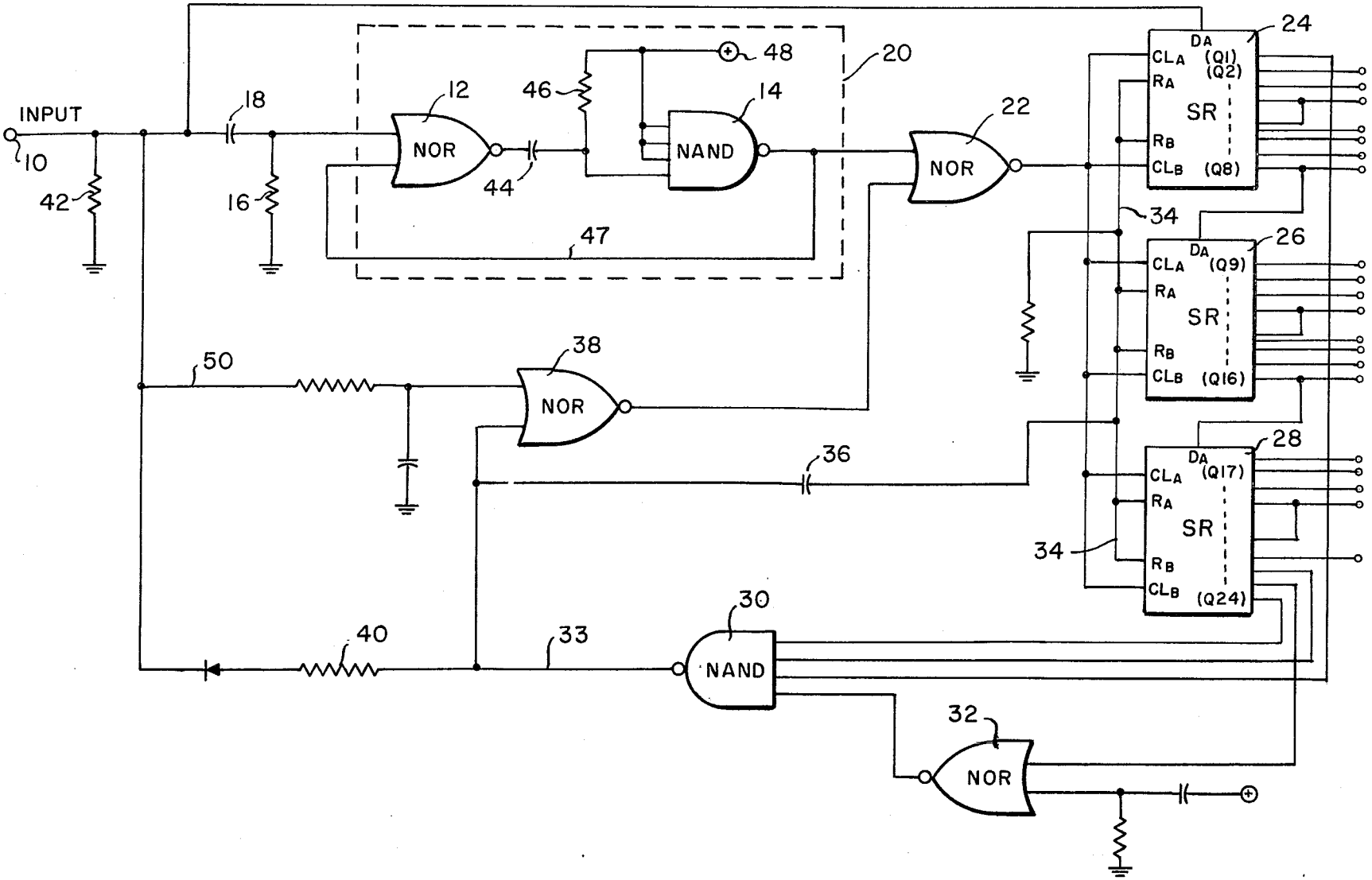
24
26
28
SR
DA
(Q1)
(Q2)
(Q8)
(Q9)
(Q16)
(Q17)
(Q24)
CLA
RA
RB
CLB
34
22
NOR
20
48
14
NAND
46
44
47
12
NOR
38
NOR
36
30
NAND
32
NOR
33
40
18
16
50
INPUT
10
42

FUNCTION SELECTOR

BACKGROUND OF THE INVENTION

The present invention relates to firing mechanisms in general, and more particularly to electronic control of firing mechanisms.

The various settings of arming times, self destruct times, logic modes, etc., of mine firing mechanisms have been set by rotating several miniature selector switches or cutting any of several tabs in the mechanism. Use of these switches required extensive hard wiring which undoubtedly became a factor in cost of the mechanism. The switches were tiny, delicate pieces of hardward which had intrinsically all of the problems of unreliability of switches, such as dirty contacts, rotated and left between normal positions, failure during shock. The tabs were, for all practical purposes, a one-shot affair. They could be cut once; to reconnect them was time consuming. Not cutting the tab in two places so a sizeable gap existed was unreliable since the shock of impact could cause the ends of the tabs to touch. In order to reprogram the firing mechanism having tabs and switches, the mechanism must be moved from the bomb case, if already installed; the battery cap and battery must be removed, and the switches must be repositioned, the tabs cut or resoldered. Under these conditions, it would be almost essential to retest the entire mechanism, as resoldering any electronic device could cause a failure of circuit components.

SUMMARY OF THE INVENTION

Accordingly, there is provided a settable electronic circuit designed to accept coded information and thus operate on the logic control, timing settings and various other functions of a firing mechanism. Various logical elements, including NOR and NAND gates and shift registers are uniquely arranged so as to store the incoming coded signals in the shift register for operation on the firing mechanism.

OBJECT OF THE INVENTION

It is therefore an object of the present invention to provide electronic control of a firing mechanism.

Another object of the present invention is to provide an unlimited number of options in a firing mechanism.

Still another object of the present invention is to provide a reliable, compact, electronic solid state function selector.

Yet another object of the present invention is to provide a permanent, easily testable electronic function selector for a mine firing mechanism.

BRIEF DESCRIPTION OF THE DRAWING

Still other objects, advantages and features will become apparent to those of ordinary skill in the art by reference to the following detailed description of a preferred embodiment of the apparatus and appended claims. The various features of the exemplary embodiment according to the invention may be best understood with reference to the accompanying drawing, wherein:

The FIGURE illustrates in block diagram form the function selector according to the present invention.

DESCRIPTION OF THE PREFERRED EMBODIMENT

Referring now to the FIGURE, there is shown the function selector according to the present invention, to operate on the input information signals entered serially at terminal 10. A two input NOR gate 12, and a four input NAND gate 14, (used as an inverter), are combined to form a monostable multivibrator 20 (one-shot) with a pulse width of approximately 3 milliseconds. The input of the multivibrator 20 is differentiated in an RC circuit comprising resistor 16 and capacitor 18 so that a narrow pulse (<<1 ms) triggers the multivibrator. The output of multivibrator 20 is inverted through a NOR gate 22, and entered into the clock inputs of eight stage serial shift registers, 24, 26 and 28. Since it is the positive going edge of a pulse which clocks information into the shift register 24, 26, 28 and since the output from the multivibrator 20 is inverted, the multivibrator clocks the shift register at the end of its pulse. If the pulse on the input line is of shorter duration (nominally 1 ms) than the multivibrator 20 pulse (3 ms), the data input line of the shift register 24, connected to the input, sees a low voltage (logical "0") when the clock pulse occurs and a zero is shifted into the shift register 24. If the pulse on the input line is longer (nominally 5 ms) than the multivibrator pulse, the data input line is high during the clock pulse and a logical "1" is shifted in. Thus, by sending a series of short (1 ms) and long (5 ms) pulses, information may be entered into the shift registers 24, 26 and 28.

The three "most significant bits", Q22, Q23, and Q24, and the "least significant bit", Q1, of shift registers 28 and 24, respectively, are monitored. A four input NAND gate 30, coupled to bits Q1, Q22, and Q24, and a two input NOR gate 32, coupled to bit Q23, monitor these "code" bits. The NOR gate, 32, also forces the output of NAND gate 30, high to trigger the reset line 33 of shift registers 24, 26 and 28 through capacitor 36 when power is turned on. When the code on Q1, Q22, Q23 and Q24 is incorrect, the output of the NAND gate 30 is high, enabling inverter 22 through NOR gate 38. While NAND gate 30 is high, a voltage approximately equal to 1/10 of the supply voltage is applied to the data input line 10 (divided through resistors 40 and 42, resistor 40 being 10 times greater than resistor 42). This voltage will not trigger any inputs in the function selector, but will indicate that the correct code has not been received.

When the correct code has been shifted into place — a "one" in Q24, a "zero" in Q23, a "one" in Q22 and a "one" in Q1, NAND gate 30, goes low. This low disables clock inverter 22, through NOR gate 38, and indicates the correct code with no voltage at the data input terminal 10. Noise pulses cannot shift the data since the clock inverter 22 is disabled.

In order to reset the shift registers 24, 26, 28 a continuous pulse of 10 seconds duration must be applied at the input terminal 10. This changes the state of the NOR gate 38, through line 50, controlling the clock inverter 22, and forcing the clock input to the shift register 24 high and shifts in a "one". Immediately, NAND gate 30 detects the incorrect code. The output of NAND gate 30 goes high, which resets all the outputs (Q1 through Q24) of the shift register 24, 26, 28, to zero and enables clock inverter 22 through NOR gate 38.

Setting the shift registers 24, 26, 28 to zero at turn-on, and when resetting the code, is an important aspect of the circuit because the random state which the shift registers might attain at turn-on, or the previously entered information being shifted through, cannot be mistaken for the correct code. The output states of Q1 through Q24 being initially zero, the correct code arriving at Q24, Q23, and Q22 verifies that all of the outputs of the shift registers 24, 26, 28 working.

Also critical to the operation of the function selector is the differentiating input to multivibrator 20. Normally, both inputs to NOR gate 12 are low and its output is high. The input to NAND gate 14 is high; its output is low and is tied back to one of the inputs of NOR gate 12 through line 47. When a positive-going pulse comes into the NOR gate 12 its output of inverter 14, goes high. This high on line 47, the input of NOR gate 12, holds its output low after the triggering pulse goes low. Capacitor 44, charges up through resistor 46, determining the time constant. When the voltage on capacitor 44 reaches approximately 45% of the supply voltage 48, the inverter 14 sees a high on its input and the output begins to switch low. NOR gate 12, then has both inputs low and switches high. The voltage on inverter 14 side of capacitor 44 is immediately snapped up to 145% of the supply voltage (this voltage bleeds down to the supply voltage rapidly through protective diodes within NAND gate 14 on the input to inverter 14). Switching in this case is sharp; the rise time is less than 20 nsec. However, if the triggering pulse is held on at the input of NOR gate 12, when capacitor 44 reaches 45% of the supply voltage, inverter 14 starts to go low, NOR gate 12 is not switched so the capacitor 44 continues to charge slowly through resistor 46. Switching in the inverter 14 is not rapid since the input is in the "active" region for a longer period. When measured at the output of the clock pulse inverter 22, the clock pulse rise-time exceeds 10 $\mu$s.

When the function selector is quiescent, i.e., the correct code is entered, the current drain is less than 100 nanoamperes. The information stored in the shift registers 24, 26, 28 can be maintained therein at least 1 hour. Once the shift registers 24, 26, 28 are programmed the power can be momentarily interrupted with no loss of information.

Thus it is apparent that there has been provided by this invention a function selector, that once properly programmed, can be assumed to be as reliable as the firing mechanism itself, since the electronics employ the same type of solid state electronics (c/mos) used in the firing mechanism circuitry. Further, the circuitry can be integrated into one of the larger timing or logic chips in the firing mechanism, thereby consuming practically no space. Under present configuration, 20 separate functions can be independently controlled, allowing a theoretical $2^{20}$ combinations. Reprogramming of the function selector can be made without its removal from the bomb case, therefore not requiring retesting of the mechanism. Similarly, testing of the function selector is a simple matter.

Obviously many modifications and variations of the present invention are possible in light of the above teachings. The function selector employs COS/MOS packages having high input impedance, low current drain, wide voltage range, dependable switching, and high reliability. The circuit could be designed with P/MOS if different switching and current drain requirements are taken into account. The function selector could be integrated into one chip using hybrid circuit technology or straight LSI methods. More than twenty functions could be achieved by increasing the number of shift registers or changing the code. It is therefore to be understood that within the scope of the appended claims the invention may be practiced otherwise than as specifically described.

What is claimed as new and desired to be secured by Letters Patent of the U.S. is:

1. A function selector for receiving coded information for programming a firing mechanism comprising:

a monostable multivibrator for receiving an input signal and supplying output signals;

an inverter coupled to the output of said multivibrator for receiving said output signals;

shift register means coupled to the output of said inverter for receiving output signals from said inverter, said shift register further coupled directly to said input signal; and logic means coupled to said shift register means for detecting an incorrect code in said shift register means to reset said shift register means.

2. A function selector as recited in claim 1 wherein said inverter comprises a first NOR gate and said logic means comprises a NAND gate coupled to four outputs of said shift register means, said NAND gate output coupled to the reset of said shift register means.

3. A function selector as recited in claim 2 further including differentiating means coupled between the input signal and said monostable multivibrator.

4. A function selector for receiving coded information for programming a firing mechanism comprising:

differentiating means for receiving an input signal and for providing an output signal which is a differentiated input signal;

a monostable multivibrator coupled to said differentiating means for receiving said differentiated input signal and supplying output signals, said monostable multivibrator comprising a first NOR gate coupled to said differentiating means and a first NAND gate coupled to the output of the said first NOR gate;

an inverter coupled to the output of said multivibrator for receiving said output signals, said inverter comprising a second NOR gate;

shift register means coupled to the output of said inverter for receiving said output signals from said inverter, wherein an input pulse of shorter duration than that of the monostable multivibrator output pulse causes said inverter to produce a zero input to said shift register means, and an input pulse of longer duration than that of the monostable multivibrator output pulse causes said inverter to produce a one input to said shift register means; and logic means coupled to said shift register means for detecting an incorrect code in said shift register means to reset said shift register means, said logic means comprising a second NAND gate coupled to four outputs of said shift register means, said second NAND gate output coupled to the reset of said shift register means.

5. A function selector as recited in claim 4 wherein said shift register means comprises three eight stage serial shift registers, and wherein said correct code begins with one, zero, one.

6. A function selector as recited in claim 5 wherein said second NAND gate is further coupled to said second NOR gate through a third NOR gate.

7. A function selector for receiving coded information for programming a firing mechanism comprising:

differentiating means for receiving an input signal;

a monostable multivibrator coupled to said differentiating means for receiving said differentiated input signal and supplying output signals, said multivibrator comprising a NOR gate coupled to said differentiating means and a NAND gate coupled to the output of said NOR gate;

an inverter coupled to the output of said multivibrator for receiving said output signals; and shift register means coupled to the output of said inverter for receiving said output signals from said inverter, wherein an input pulse of shorter duration than that of the monostable multivibrator output pulse causes said inverter to produce a zero input to said shift register means, and an input pulse of longer duration than that of the monostable multivibrator output pulse causes said inverter to produce a one input to said shift register means.

* * * * *